US005706610A

United States Patent [19]

Mayle

[11] Patent Number: 5,706,610

[45] Date of Patent: Jan. 13, 1998

[54] ADJUSTABLE ROOF MEMBRANE

[76] Inventor: Robert L. Mayle, 2047 Hyde Rd., Port Clinton, Ohio 43452

[21] Appl. No.: 627,898

[22] Filed: Apr. 3, 1996

[51] Int. Cl.[6] ..... F04D 1/36; F04D 13/14

[52] U.S. Cl. ..... 52/60; 52/58; 52/198; 285/42

[58] Field of Search ..... 52/198, 199, 58, 52/60, 219, 218, 200, 72; 285/42, 43, 44

[56] References Cited

U.S. PATENT DOCUMENTS

| | | | |
|---|---|---|---|
| 4,603,517 | 8/1986 | Lyons, Jr. | 52/60 |
| 4,635,409 | 1/1987 | Vandemore | 52/60 |
| 4,799,986 | 1/1989 | Janni . | |
| 4,872,296 | 10/1989 | Janni . | |
| 5,077,943 | 1/1992 | McGady | 52/219 X |

OTHER PUBLICATIONS

Author –N/A, GenFlex Product Details for Field Fabricated Outside Corner, Dec. 1, 1994.

*Primary Examiner*—Wynn E. Wood
*Assistant Examiner*—Timothy B. Kang
*Attorney, Agent, or Firm*—Standley & Gilcrest

[57] ABSTRACT

A universal fitment for use with polymer-coated roof membranes to cover areas on and around vertical protrusions in a roof. The universal fitment has a body with preferably three sides, a tab, and a neck connecting a corner of the body to the tab. The body is preferably either substantially square or substantially triangular. A universal boot is also disclosed. The universal boot has a generally rectangular section with a split extending vertically in a side, and a fitment with a body having at least three sides, a tab, and a neck connecting a corner of the body to the tab. The tab of the fitment is preferably welded to the back of the rectangular section above the split.

9 Claims, 4 Drawing Sheets

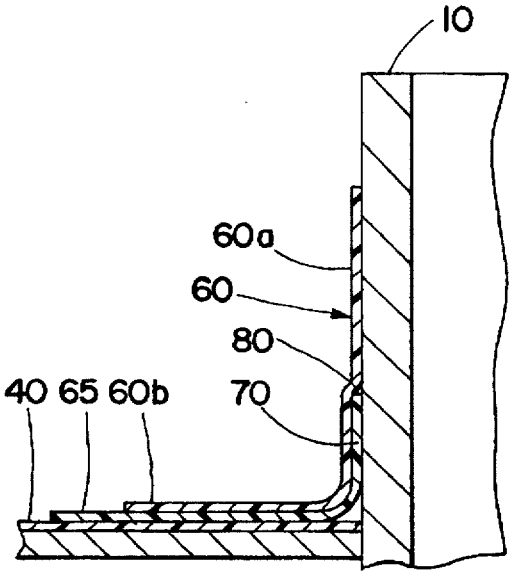
Fig. 7
Fig. 8
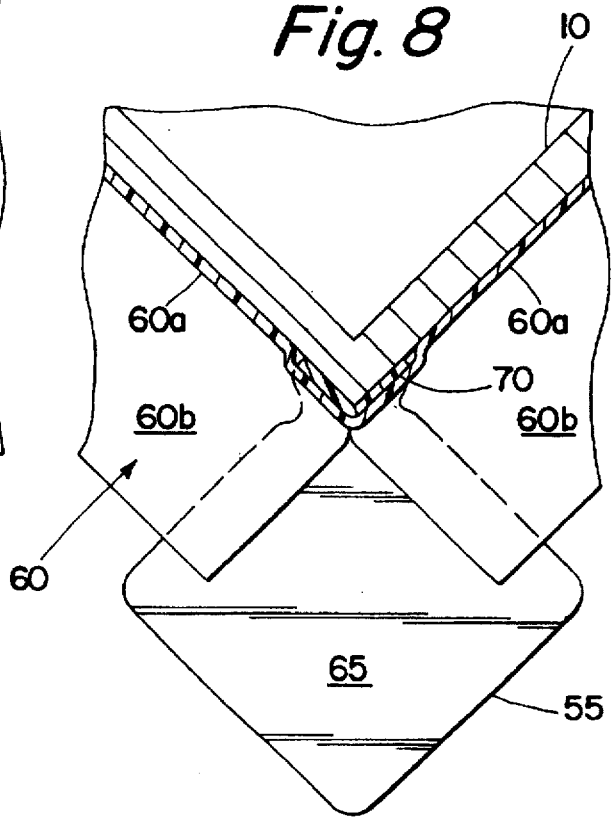
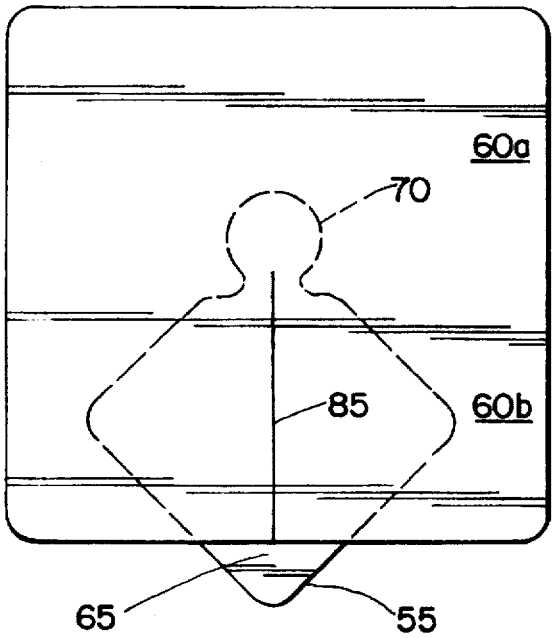
Fig. 9

ADJUSTABLE ROOF MEMBRANE

BACKGROUND AND SUMMARY OF THE INVENTION

The invention generally relates to roof-covering membranes, and more particularly relates to a universal, adjustable fitment for use with roof-covering membranes.

Polymer coated membranes are commonly used to cover essentially flat roofs. The membrane is custom designed for the particular roof on which it is to be used. The roof measurements are provided to the factory which creates a unitary membrane from separate pieces which have been heat welded together.

There are frequently items protruding from the surface of the roof, such as vents, ductwork, air conditioning units, and the like. The size and location of these items must also be provided to the factory so that accommodations can be made for them in the membrane.

Providing a water-tight seal around these protrusions presents a number of problems. U.S. Pat. Nos. 4,799,986 and 4,872,296 disclose a method and a fitment which have been used to cover the corners of protrusions. The corners comprise a first generally rectangular member segment, a side being part-way split interjacent its ends and a second member segment with a triangularly-shaped corner portion conformed to loop shape and having its marginal edges overlying portions of the first segment contiguous to the split and being welded thereto in a continuous weld seam. These known items work best when the corner is a right angle and the angle between the roof and the protrusion is a right angle.

However, in many cases the corner will not be a right angle, or the protrusion is not at a right angle to the roof, or there is some other irregularity in the protrusion, such as the bottom and the top being of different sizes. In these situations, known methods do not provide satisfactory results. The membrane must be folded or "bunched" in order to conform the membrane to the underlying structure. Not only is this folding and bunching unsightly, water can collect in the fold which can have deleterious effects on the roofing membrane and/or can lead to localized leaks at seams and at other places in the membrane. In addition, the folding can lead to cracking of the roof membrane over time, due in part to stresses induced by the fold lines.

Therefore, it is desirable to provide a universal fitment which provides a smooth transition no matter what the shape or angle of the underlying protrusion and which eliminates the need to fold the roof membrane.

The present invention provides a universal fitment that is useful with roof membranes to cover exposed roof areas around a vertical protrusion in a roof. The fitment is partially secured to the roof membrane prior to the membrane being installed on the roof. Once the roof membrane is in place at the vertical protrusion, the floating portion of the fitment is finally secured to the roof membrane, substantially free of folds and bunching of material.

BRIEF DESCRIPTION OF THE DRAWINGS

FIG. 7 is an enlarged cross-sectional view taken on the line 7—7 of FIG. 2;

FIG. 8 is an enlarged cross-sectional view taken on the line 8—8 of FIG. 2;

FIG. 9 is a fragmentary elevational view of a boot of the present invention;

DESCRIPTION OF THE INVENTION

The present invention involves a universal fitment for use with polymer-coated roof membranes to cover vertical protrusions in a roof, having a body with multiple sides, a tab, and also preferably having a neck connecting the fitment to the tab. The body of the fitment is preferably either substantially square or substantially triangular, but other shapes and sizes would also work well in particular uses of the invention.

The invention also involves a universal boot for use in covering vertical protrusions in a roof. The universal boot has a generally rectangular section having a split in a side, the split extending vertically from the bottom to a point intermediate between the bottom and the top of the rectangular section, the area above the split being an upper section and the area including the split being a lower section, and a fitment with a body having multiple sides, a tab, and a neck connecting a corner of the body to the tab. The tab of the fitment is preferably welded to the rectangular section above the split, so that when the rectangular section is placed around the vertical protrusion, the upper section is positioned adjacent to the vertical protrusion, the lower section is positioned on the roof, the split allowing the lower section to separate, and the fitment covering the space formed by the separation of the lower section. The tab of the fitment is preferably welded to the back of the rectangular section.

Figure 1:
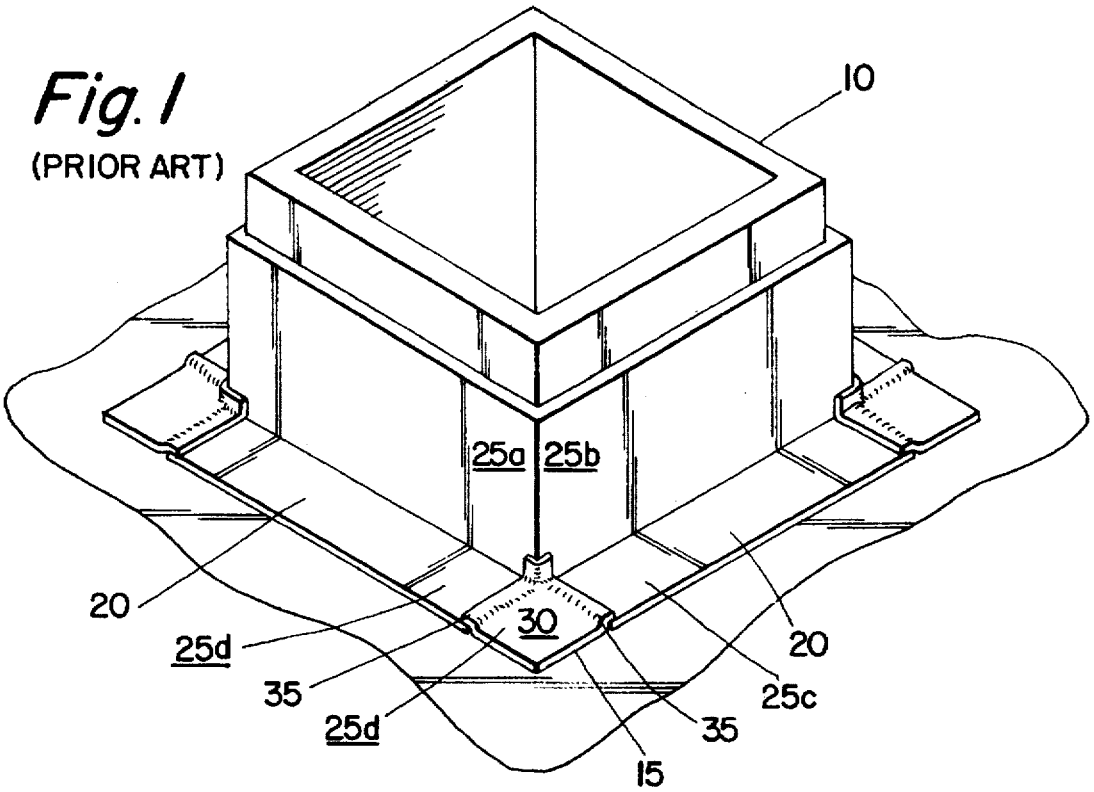
Fig. 1 (PRIOR ART)
FIG. 1 is a perspective view of the corner piece of the prior art.

FIG. 1 shows the corner piece of the prior art. The corner piece 15 is heat welded at the factory to the spanning pieces 20. The corner piece 15 consists of two parts, a first segment 25 and a second segment 30. The first segment has an upper portion 25*a* and 25*b* and a lower portion 25*c* and 25*d*. The second segment 30 is heat welded at the factory to the lower portion 25*c* and 25*d* of the first segment 25 at weld lines 35. When the corner piece 15 is placed around the corner of the vent 10, the upper portions 25*a* and 25*b* of the first segment are positioned adjacent the sides of the vent, and the lower portions 25*c* and 25*d* are positioned on the roof. The second segment 30 lies flat on the surface of the roof between lower portions 25*c* and 25*d*.

However, when the angle between the vent and the roof is not 90°, or the angle between the sides of the vent is not 90°, or when there is some other irregularity in the protrusion, the corner piece will not lie flat on the roof. The corner piece must be folded in order for it to lie smoothly on the surface of the roof.

Figure 2:
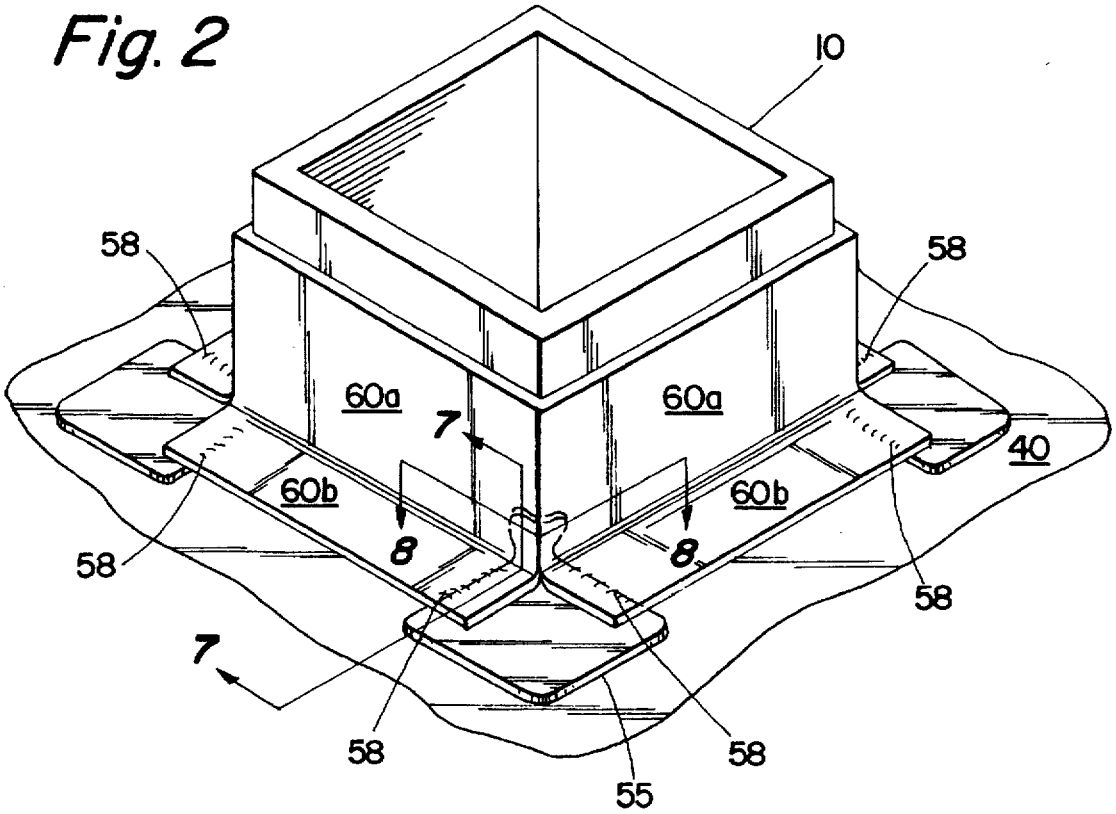
FIG. 2 is a perspective view of the fitment of the present invention.

One embodiment of the present invention is shown in FIG. 2. The vent 10 protrudes from the roof. A boot 60 is placed around the vent 10. The boot 60 has an upper section 60*a* positioned adjacent the side of the vent 10, and a lower section 60*b* positioned on the roof. The fitment 55 is heat welded at the factory to the back of the boot. The boot welds 58 are made on site when the membrane is placed on the roof. The on site welding of the fitment 55 to the lower section 60*b* of the boot allows it to accommodate any angle or shape of protrusion.

Figure 3:
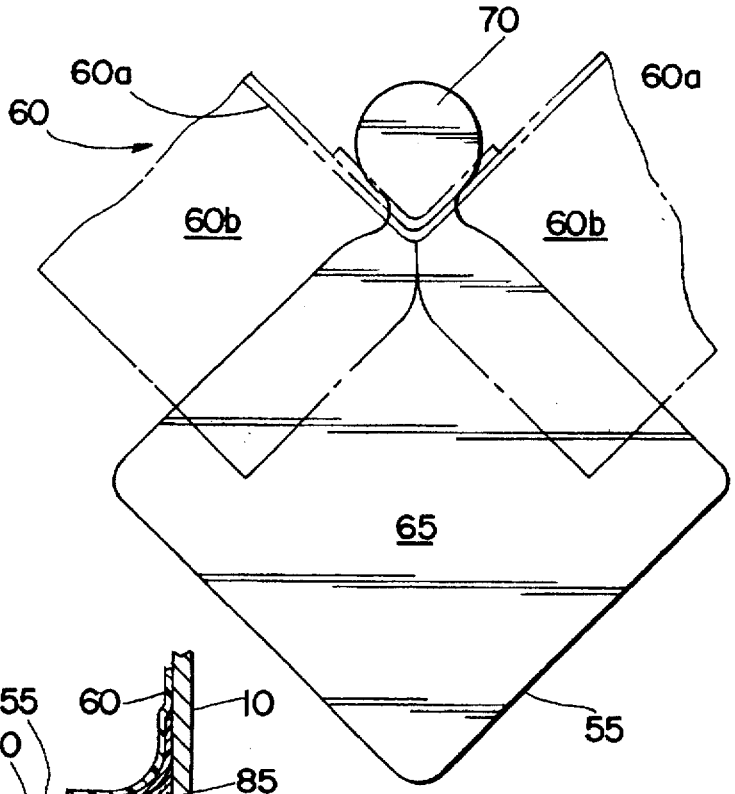
FIG. 3 is fragmentary top plan view of the present invention.

FIG. 3 shows the fitment 55 in more detail. The fitment has a body 65. The body 65 is preferably substantially square. The fitment 55 has a tab 70 which is connected to a corner of the body by a neck 75. The tab is preferably substantially circular, but it can be made in any suitable shape.

Figure 4:
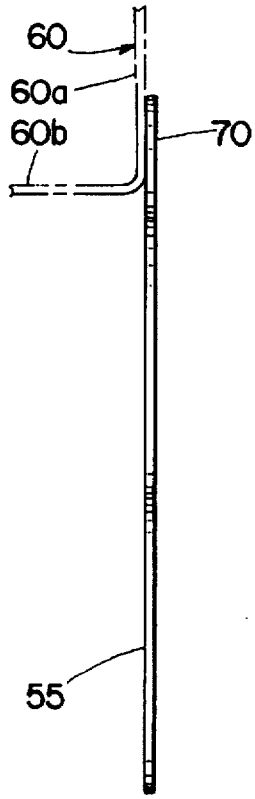
FIG. 4 is a cross-sectional view taken from FIG. 3.

FIG. 4 shows a cross-section of the boot 60 and the fitment 55. The tab 70 of the fitment 55 is welded to the boot 60 at weld 80. The tab is preferably welded to the back of the boot as shown. This arrangement reduces the opportunity for moisture to cross the roof membrane.

Figure 5A:
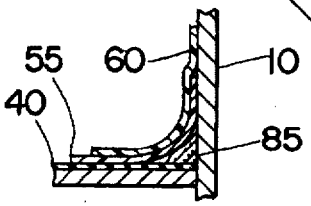
FIG. 5*a* is a cross-sectional view of the corner shown in FIG. 5.
Figure 5:
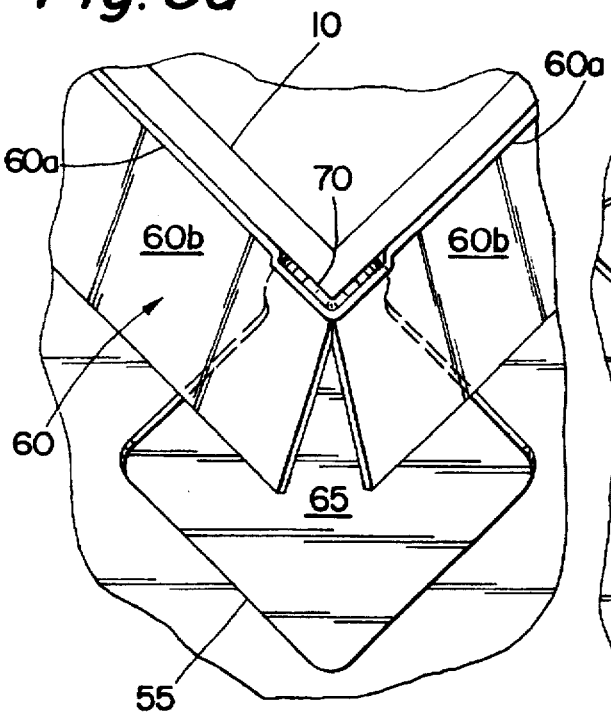
FIG. 5 is a fragmentary top plan view of the present invention.
Figure 6:
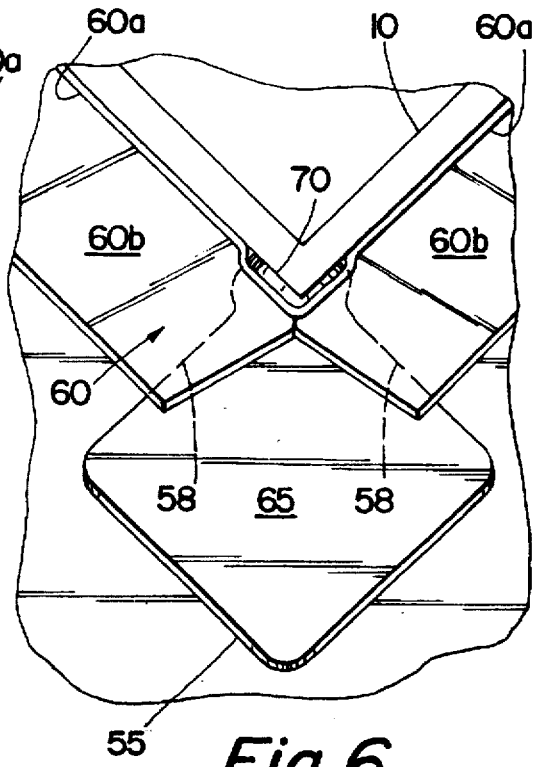
FIG. 6 is a fragmentary top plan view of the present invention.

FIGS. 5, 5*a*, and 6 show the fitment 55 of the present invention used with corners having angles other than right angles. As can be seen in FIG. 5*a*, the protrusion does not intersect the roof at a right angle. There is an intermediate area 85. This intermediate area 85 may be part of the shape of the protrusion itself, or it could have been caused by the buildup of previous roof membranes. Since the boot welds 58 are made at the site, the fitment can be adjusted to fit the underlying structure smoothly. The fitment 55 easily accommodates a wide variety of angles.

In FIG. 7, the upper section 60*a* of the boot is adjacent to the side of vent 10. The tab 70 of fitment 55 is welded to the back side of boot 60. The body 65 of the fitment 55 lies on the roof membrane 40 underneath the lower section 60*b* of the boot. The tab 70 is between boot 60 and the vent 10, as seen in FIG. 8.

Figure 10:
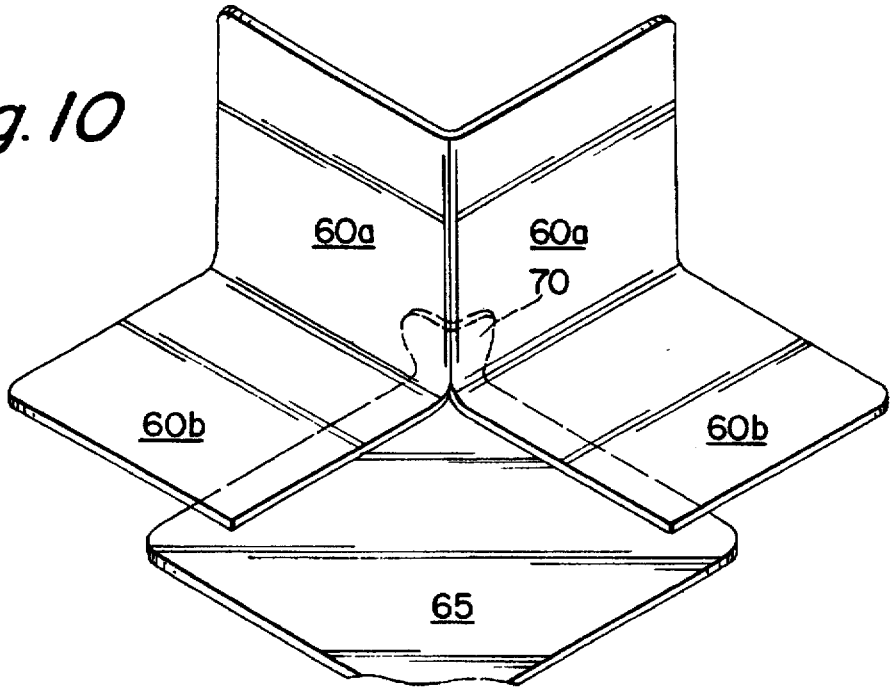
FIG. 10 is a perspective view of the boot and fitment of the present invention.

FIG. 9 shows the split 85 in the boot 60. The tab 70 of the fitment 55 is located above the split 85. Part of the body 65 of the fitment 55 extends below the boot 60. The split 85 divides the boot into two sections: an upper section 60*a* above the split 85 and a lower section 60*b* including the split 85. When the boot 60 is folded as it would be for a corner, as shown in FIG. 10, the upper section 60*a* would be adjacent the protrusion and the lower section 60*b* would be along the roof. The body 65 of the fitment 55 would lie under the edges of the lower section 60*b*. The fitment 55 could be adjusted to the protrusion as necessary to provide a smooth flat corner, and then heat welded on site.

Figure 11:
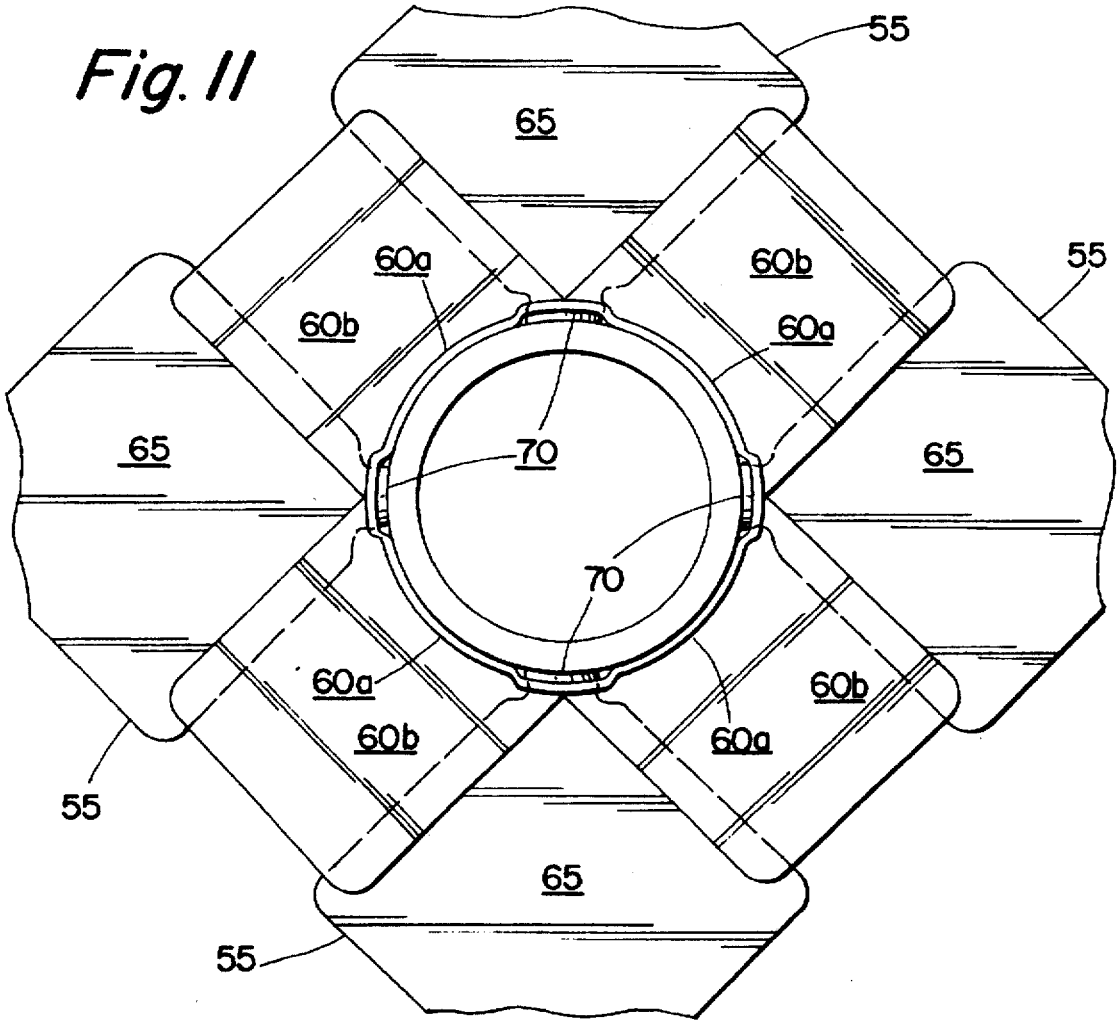
FIG. 11 is a top plan view of an alternative embodiment of the present invention.

FIG. 11 shows an alternative embodiment of the present invention. When the protrusion is circular, the fitments 55 are preferably substantially triangular in shape or pie shaped. The number of fitments required, the preferred shape of each fitment, and their placement and arrangement will depend on the size and curvature of the protrusion.

The scope of the invention is not to be considered limited by the above disclosure, and modifications are possible without departing from the spirit of the invention as evidenced by the following claims.

What is claimed is:

1. A fitment for use with polymer-coated roof membranes to cover a vertical protrusion in a roof, said vertical protrusion enclosed by a boot, said boot having a split in a side, the split extending vertically from the bottom of said boot to a point intermediate between said bottom of said boot and the top of said boot, the area above said split being an upper section and the area including the split being a lower section, and whereby when said boot is placed around said vertical protrusion, said upper section is positioned adjacent said vertical protrusion and said lower section is positioned over the roof, said split allowing said lower section to separate, comprising:

a body portion having multiple sides for sealing an area adjacent said vertical protrusion, wherein said body portion is of a predetermined size large enough to cover the space formed by the separation of said lower section so that said body portion of said fitment lies under said lower section of said boot along said split and wherein said body portion of said fitment may be sealed to said lower section of said boot along the entire length of said split;

a tab at one end of said body portion, said tab adapted to be secured to a location on said boot above said split and where said boot accommodates said vertical protrusion;

wherein at least one side of said multiple sides of said body portion is adapted to be secured to said roof membrane; and wherein a water-tight seal is formed when said body portion of said fitment is sealed to said lower section of said boot.

2. The universal fitment of claim 1 wherein the body is substantially square.

3. The universal fitment of claim 1 wherein the body is substantially triangular.

4. A universal boot for use in covering vertical protrusions in a roof, comprising:

a generally rectangular section having a split in a side, the split extending vertically from the bottom to a point intermediate between the bottom and the top of the rectangular section, the area above the split being an upper section and the area including the split being a lower section; and a fitment having a body having multiple sides, a tab, and a neck connecting a corner of the body to the tab, the tab of the fitment being welded to the rectangular section above the split, whereby when the rectangular section is placed around the vertical protrusion, the upper section is positioned adjacent the vertical protrusion, the lower section is positioned on the roof, the split allowing the lower section to separate, and wherein the fitment covers the space formed by the separation of the lower section.

5. The universal boot of claim 4 wherein the body is substantially square.

6. The universal boot of claim 4 wherein the body is substantially triangular.

7. The universal boot of claim 4 wherein the tab of the fitment is welded to the back of the rectangular section.

8. A method for installing a roof membrane on a roof having at least one vertical protrusion, said method comprising:

providing a material fitment for use with said roof membrane at said vertical protrusion;

securing a first portion of said fitment to said roof membrane, prior to said roof membrane being placed on said roof, such that a second portion of said fitment is free to later be secured to said roof membrane when said roof membrane is substantially in place with respect to said vertical protrusion;

arranging said fitment at said vertical protrusion on said roof to cover an exposed portion of said roof, while maintaining said fitment and said roof membrane substantially free of material bunching; and securing said second portion of said fitment to said roof membrane.

9. The method of claim 8, wherein said securing is heat welding.

* * * * *